US009726053B2

(12) United States Patent
Nunami et al.

(10) Patent No.: US 9,726,053 B2
(45) **Date of Patent: *Aug. 8, 2017**

(54) VALVE OPENING/CLOSING TIMING CONTROL DEVICE

(71) Applicant: AISIN SEIKI KABUSHIKI KAISHA, Kariya-shi, Aichi (JP)

(72) Inventors: Koji Nunami, Obu (JP); Takashi Iwaya, Obu (JP); Hiroyuki Amano, Kariya (JP); Masaki Kobayashi, Okazaki (JP)

(73) Assignee: AISIN SEIKI KABUSHIKI KAISHA, Kariya-Shi, Aichi (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/772,144

(22) PCT Filed: Jun. 25, 2014

(86) PCT No.: PCT/JP2014/066854

§ 371 (c)(1),
(2) Date: Sep. 2, 2015

(87) PCT Pub. No.: WO2015/015960

PCT Pub. Date: Feb. 5, 2015

(65) Prior Publication Data

US 2016/0017767 A1 Jan. 21, 2016

(30) Foreign Application Priority Data

Jul. 29, 2013 (JP) ..... 2013-156936

(51) Int. Cl.

| | |
|---|---|
| ***F01L 1/34*** | (2006.01) |
| ***F01L 1/24*** | (2006.01) |
| ***F01L 1/344*** | (2006.01) |

(52) U.S. Cl.
CPC ..... *F01L 1/24* (2013.01); *F01L 1/344* (2013.01); *F01L 1/3442* (2013.01);
(Continued)

(58) Field of Classification Search
CPC . F01L 1/24; F01L 1/344; F01L 1/3442; F01L 2001/3443; F01L 2001/34463; F01L 2001/34466
(Continued)

(56) References Cited

U.S. PATENT DOCUMENTS 6,976,460 B2 * 12/2005 Komazawa et al. .... F01L 1/022 123/90.15
2010/0139592 A1 6/2010 Takemura
(Continued)

FOREIGN PATENT DOCUMENTS

CN 102639823 A 8/2012
JP 2007-132272 A 5/2007
(Continued)

OTHER PUBLICATIONS

English language translation of International Preliminary Report on Patentability and Written Opinion of the International Searching Authority (Forms PCT/IB/338, PCT/IB373 and PCT/ISA/237) issued on Feb. 11, 2016, by the International Bureau of WIPO, in corresponding International Application No. PCT/JP2014/066854. (5 pages).
(Continued)

*Primary Examiner* — Ching Chang
(74) *Attorney, Agent, or Firm* — Buchanan Ingersoll & Rooney PC

(57) ABSTRACT

A valve opening/closing timing control device includes: an intermediate lock mechanism switchable between a locked state constraining a relative rotation phase to an intermediate locked phase, and an unlocked state releasing the constraint;
(Continued)

a phase control unit controlling fluid supply to a retard chamber and fluid discharge from an advance chamber, or controlling fluid discharge from the retard chamber and fluid supply to the advance chamber, such that the lock member attains the intermediate locked phase; and a determination unit determining whether the lock member will attain the determination phase, when control has been performed to move the lock member toward a determination phase that has been set at a different position than the intermediate locked phase, after execution of control to either supply fluid to the retard chamber and discharge fluid from the advance chamber, or discharge fluid from the retard chamber and supply fluid to the advance chamber.

6 Claims, 6 Drawing Sheets

(52) U.S. Cl.
CPC ..... *F01L 2001/3443* (2013.01); *F01L 2001/34463* (2013.01); *F01L 2001/34466* (2013.01); *F01L 2001/34473* (2013.01); *F01L 2001/34483* (2013.01); *F01L 2250/02* (2013.01); *F01L 2800/00* (2013.01)

(58) Field of Classification Search
USPC ..... 123/90.15, 90.17
See application file for complete search history.

(56) References Cited

U.S. PATENT DOCUMENTS

| | | | |
|---|---|---|---|
| 2010/0269772 | A1 | 10/2010 | Takemura et al. |
| 2011/0023805 | A1 | 2/2011 | Takemura |
| 2012/0085303 | A1 | 4/2012 | Kobayashi et al. |

FOREIGN PATENT DOCUMENTS

| | | | |
|---|---|---|---|
| JP | 2010-138699 | A | 6/2010 |
| JP | 2010-255499 | A | 11/2010 |
| JP | 2011-032905 | A | 2/2011 |
| JP | 2011-132932 | A | 7/2011 |

OTHER PUBLICATIONS

International Search Report (PCT/ISA/210) mailed on Sep. 30, 2014, by the Japanese Patent Office as the International Searching Authority for International Application No. PCT/JP2014/066854.
Written Opinion (PCT/ISA/237) mailed on Sep. 30, 2014, by the Japanese Patent Office as the International Searching Authority for International Application No. PCT/JP2014/066854.

* cited by examiner

VALVE OPENING/CLOSING TIMING CONTROL DEVICE

TECHNICAL FIELD

The present invention relates to a valve opening/closing timing control device that controls a relative rotation phase of a driven-side rotary member that rotates in unity with a camshaft of an internal combustion engine with respect to a drive-side rotary member that rotates synchronously with a crankshaft of the internal combustion engine.

BACKGROUND ART

Conventionally, in order to achieve improved fuel economy of an internal combustion engine (referred to hereinafter as an 'engine'), a valve opening/closing timing control device has come to be used that controls an opening/closing timing of one or both of an intake valve and an exhaust valve. This type of valve opening/closing timing control device controls the above opening/closing timing by changing a relative rotation phase of a drive-side rotary member that rotates synchronously with a crankshaft and a driven-side rotary member that rotates in unity with a camshaft.

Ordinarily, the optimal opening/closing timing of intake/exhaust valves differs depending on the running circumstances of the engine, such as when starting the engine or during vehicle running. When starting the engine, by constraining the relative rotation phase of the driven-side rotary member with respect to rotation of the drive-side rotary member (referred to hereinafter as the 'relative rotation phase') to a predetermined phase between a most retarded phase and a most advanced phase, an optimal opening/closing timing of the intake/exhaust valves for starting the engine is realized. However, during idling that follows engine start-up, if the relative rotation phase is maintained at the phase used when starting the engine, the amount of hydrocarbon (HC) emissions increases, so during idling that follows engine start-up, it is desirable to change the relative rotation phase to a phase that allows the amount of HC emissions to be suppressed. Also, when performing an idling stop in which the engine is temporarily stopped when the vehicle was stopped by stepping on a brake pedal during normal running, it is desirable to change to a relative rotation phase where the engine can be restarted easily while in a high-temperature state. Related technology is disclosed in Patent Document 1 cited below.

Patent Document 1 discloses a variable valve timing control device of an internal combustion engine provided with a function to lock at an intermediate locked phase, where a rotation phase of a camshaft with respect to a crankshaft of an internal combustion engine is positioned in approximately the middle of an adjustable range of that rotation phase. This variable valve timing control device of an internal combustion engine is configured having a lock control means that controls a hydraulic control device so as to lock the rotation phase of the camshaft at the intermediate locked phase with a lock pin when a lock request has occurred. When a lock request has occurred, the lock control means controls the hydraulic control device such that the rotation phase of the camshaft moves past the intermediate locked phase while the lock pin is biased in a locking direction. During this phase variation control, when the rotation phase of the camshaft has become unable to move near the intermediate locked phase, the lock control means further changes a control amount of the hydraulic control device by a predetermined amount in a direction to move the rotation phase of the camshaft. At this time, locking is determined to be complete in a case where the rotation phase of the camshaft does not move.

CITATION LIST

Patent Literature

Patent Document 1: JP 2010-138699A

SUMMARY OF INVENTION

Technical Problem

With the technology described in Patent Document 1, control is performed such that the rotation phase of the camshaft moves past the intermediate locked phase when a lock request has occurred. Also, after that control, when the rotation phase of the camshaft has become unable to move near the intermediate locked phase, the control amount of the hydraulic control device is further changed by a predetermined amount in the direction to move the rotation phase of the camshaft, and locking is determined to be complete in a case where the rotation phase of the camshaft does not move any further. Therefore, there are cases where the rotation phase of the camshaft moves past the intermediate locked phase, and in such a case it takes time to complete locking.

The present invention was made in consideration of the foregoing problems, and it is an object thereof to provide a valve opening/closing timing control device that can quickly determine that the intermediate locked phase has been attained.

Solution of Problem

In a characteristic configuration, a valve opening/closing timing control device according to the present invention for achieving the above object includes: a drive-side rotary member that rotates synchronously with a crankshaft of an internal combustion engine; a driven-side rotary member that rotates in unity with a camshaft of the internal combustion engine, and is capable of relative rotation with respect to the drive-side rotary member; a fluid pressure chamber that is formed by the drive-side rotary member and the driven-side rotary member; a vane that is disposed within the fluid pressure chamber, and divides the fluid pressure chamber into a retard chamber and an advance chamber that permit inflow or discharge of a fluid, and selectively moves a relative rotation phase of the driven-side rotary member with respect to the drive-side rotary member between a retard direction in which volume within the retard chamber increases due to inflow of the fluid and an advance direction in which volume within the advance chamber increases due to inflow of the fluid; an intermediate lock mechanism that includes a lock member provided in any one of the drive-side rotary member and the driven-side rotary member and is capable of moving with respect to the other, and a recess that extends in a circumferential direction and is provided in the other of the drive-side rotary member and the driven-side rotary member, the intermediate lock mechanism being capable of switching between a locked state in which the relative rotation phase is constrained to an intermediate locked phase between the most advanced phase and the most retarded phase by the lock member fitting into the recess, and an unlocked state in which the constraint has been released by the lock member withdrawing from the recess; a phase control unit that controls supply of the fluid to the retard chamber and discharge of the fluid from the advance chamber, or controls discharge of the fluid from the retard chamber and supply of the fluid to the advance chamber, such that the lock member attains the intermediate locked phase; and a determination unit that, after the phase control unit executes the control to supply the fluid to the retard chamber and discharge the fluid from the advance chamber, or executes the control to discharge the fluid from the retard chamber and supply the fluid to the advance chamber, when control has been performed such that the lock member moves toward a determination phase that has been set at a different position than the intermediate locked phase in the recess, determines whether the lock member will attain the determination phase, and when the result of that determination is that the lock member will not attain the determination phase, the determination unit determines that the relative rotation phase is in the locked state.

By adopting such a characteristic configuration, it is possible to easily determine whether the relative rotation phase of the driven-side rotating member with respect to the drive-side rotary member is at the intermediate locked phase, based on the result of determining whether the lock member will attain the determination phase that has been provided within the recess. That is, viewed from the current position of the lock member, in a state in which the current position of the lock member, the intermediate locked phase, and the determination phase are lined up in that order, in a case where control has been performed such that the lock member will attain the intermediate locked phase, it is possible to determine that the lock member is at the intermediate locked phase (possible to determine that the relative rotation phase of the driven-side rotary member with respect to the drive-side rotary member is at the intermediate locked phase) if the lock member does not attain the determination phase in the last determination operation (operation to move the relative rotation phase to the side of the determination phase). Also, viewed from the current position of the lock member, in a state in which the current position of the lock member, the determination phase, and the intermediate locked phase are lined up in that order, in a case where control has been performed such that the lock member will attain the intermediate locked phase, it is possible to determine that the lock member is at the intermediate locked phase if the lock member passes through the determination phase and does not attain the determination phase again in the last determination operation. Thus, according to this valve opening/closing timing control device, the determination phase is provided at a different position than the intermediate locked phase in the recess, so when shifting the relative rotation phase to the intermediate locked phase, by merely performing control using a target position where the intermediate locked phase is attained (target phase), it is possible to determine whether the lock member has attained the intermediate locked phase. Also, in the determination operation, it is sufficient to perform control such that the lock member moves to the side of the determination phase, so for example, it is possible to shorten the time required to switch a control valve. Accordingly, it is possible to quickly determine that the intermediate locked phase has been attained.

Also, it is suitable that after the phase control unit executes the control to supply the fluid to the retard chamber and discharge the fluid from the advance chamber or executes the control to discharge the fluid from the retard chamber and supply the fluid to the advance chamber, in a case where the determination unit determined that the lock member has not attained the determination phase, or when the determination unit determines whether the lock member will attain the determination phase, the phase control unit supplies the fluid alternately to each of the retard chamber and the advance chamber.

In a case where the lock member is at the intermediate locked phase, relative rotation of the drive-side rotary member and the driven-side rotary member is restricted. In such a configuration, if the lock member does not attain the determination phase, the lock member has been reliably fitted into the recess, so it is possible to confirm that the lock member is at the intermediate locked phase. Also, by increasing/decreasing the oil pressure of the retard chamber and the advance chamber, along with the oil pressure of the retard chamber and the advance chamber, the oil pressure of channels connected to the retard chamber and the advance chamber also increases/decreases, so it is possible for a foreign substance within the channels to be flushed through and removed (thus cleaning the channels).

Also, it is suitable that two each of the recess and the lock member are provided, and the determination phase is provided at any one of the two recesses, and when one of the lock members is in a state in which a phase change is restricted within the corresponding recess, the determination phase has been set to a recess that corresponds to a portion where a range of restriction for the intermediate locked phase is narrow.

By adopting such a configuration, it is possible to set the determination phase within a narrow range of restriction, so the interval between the determination phase and the intermediate locked phase can be reduced. Accordingly, it is possible to increase the precision of determining whether the relative rotation phase is at the intermediate locked phase.

Also, it is suitable that two of the recesses are provided, the length in the circumferential direction of one recess is shorter than the length of the other recess, and the determination phase is provided within the recess that has a shorter length in the circumferential direction.

With this sort of configuration as well, it is possible to set the determination phase within a narrow range of restriction, so the interval between the determination phase and the intermediate locked phase can be reduced. Accordingly, it is possible to increase the precision of determining whether the relative rotation phase is at the intermediate locked phase.

Also, it is suitable that one each of the recess and the lock member are provided, the depth of the recess increases in steps in the retard direction, and the length in the circumferential direction of a portion of the recess that is deeper than other portions is set such that when the lock member has fitted into the deep portion of the recess, displacement of the relative rotation phase of the driven-side rotary member with respect to the drive-side rotary member is prohibited.

With this sort of configuration, viewed from the current position of the lock member, in a state in which the current position of the lock member, the intermediate locked phase, and the determination phase are lined up in that order, in a case where control has been performed such that the lock member will attain the intermediate locked phase, it is possible to determine that the lock member is at the intermediate locked phase if the lock member does not attain the determination phase in the last determination operation. Also, viewed from the current position of the lock member, in a state in which the current position of the lock member, the determination phase, and the intermediate locked phase are lined up in that order, in a case where control has been performed such that the lock member will attain the intermediate locked phase, it is possible to determine that the lock member is at the intermediate locked phase if the lock member passes through the determination phase and does not attain the determination phase again in the last determination operation.

Also, it is suitable that one each of the recess and the lock member are provided, and the length in the circumferential direction of the recess is set such that in a case where the lock member has fitted into the recess, displacement of the relative rotation phase of the driven-side rotary member with respect to the drive-side rotary member is possible.

With this sort of configuration as well, viewed from the current position of the lock member, in a state in which the current position of the lock member, the intermediate locked phase, and the determination phase are lined up in that order, in a case where control has been performed such that the lock member will attain the intermediate locked phase, it is possible to determine that the lock member is at the intermediate locked phase if the lock member does not attain the determination phase in the last determination operation. Also, in a state in which, viewed from the current position of the lock member, the current position of the lock member, the determination phase, and the intermediate locked phase are lined up in that order, in a case where control has been performed such that the lock member will attain the intermediate locked phase, it is possible to determine that the lock member is at the intermediate locked phase if the lock member passes through the determination phase and does not attain the determination phase again in the last determination operation.

DESCRIPTION OF EMBODIMENTS

Figure 1:
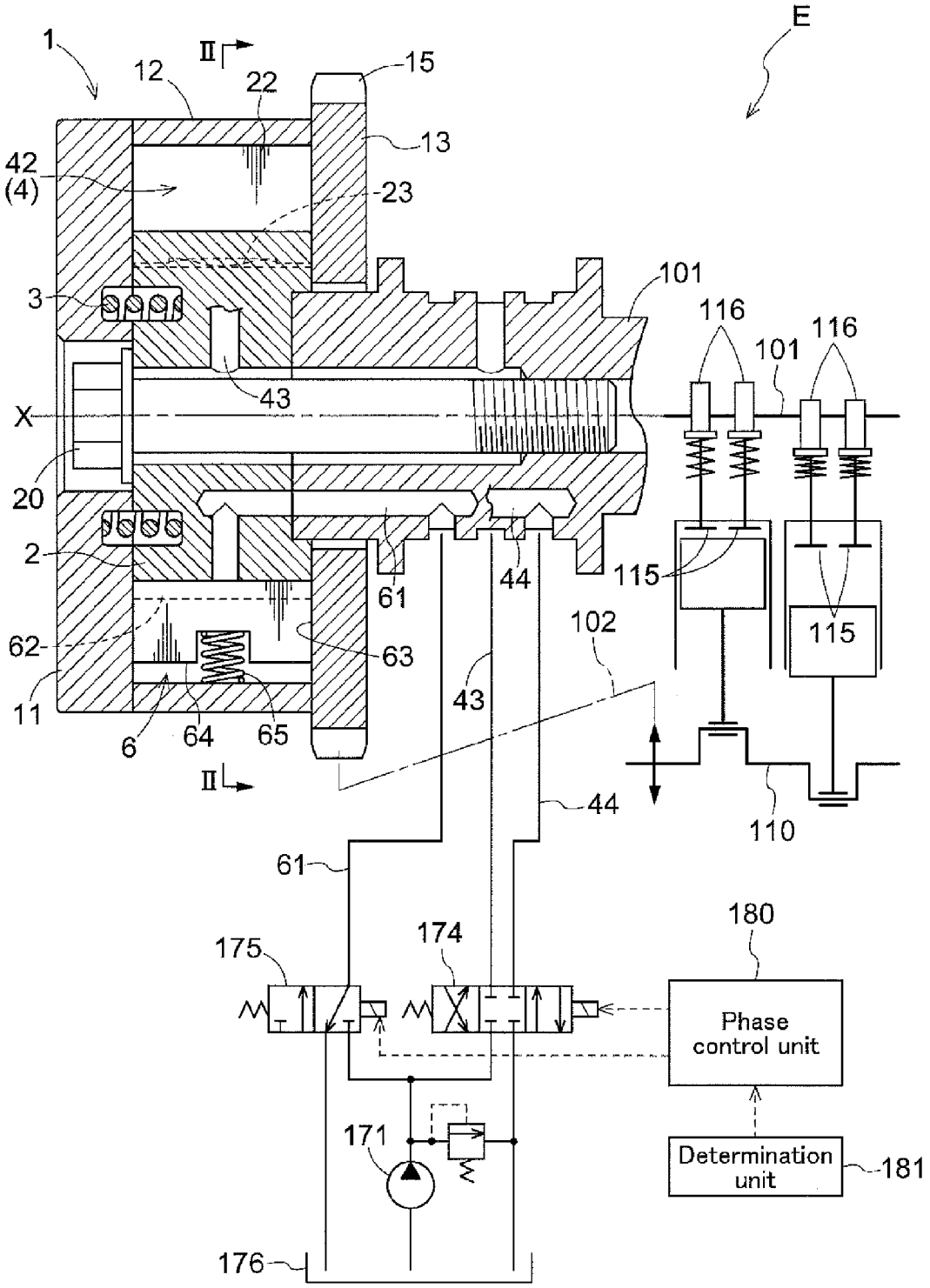
FIG. 1 is a cross-sectional view of a valve opening/closing timing control device.
Figure 2:
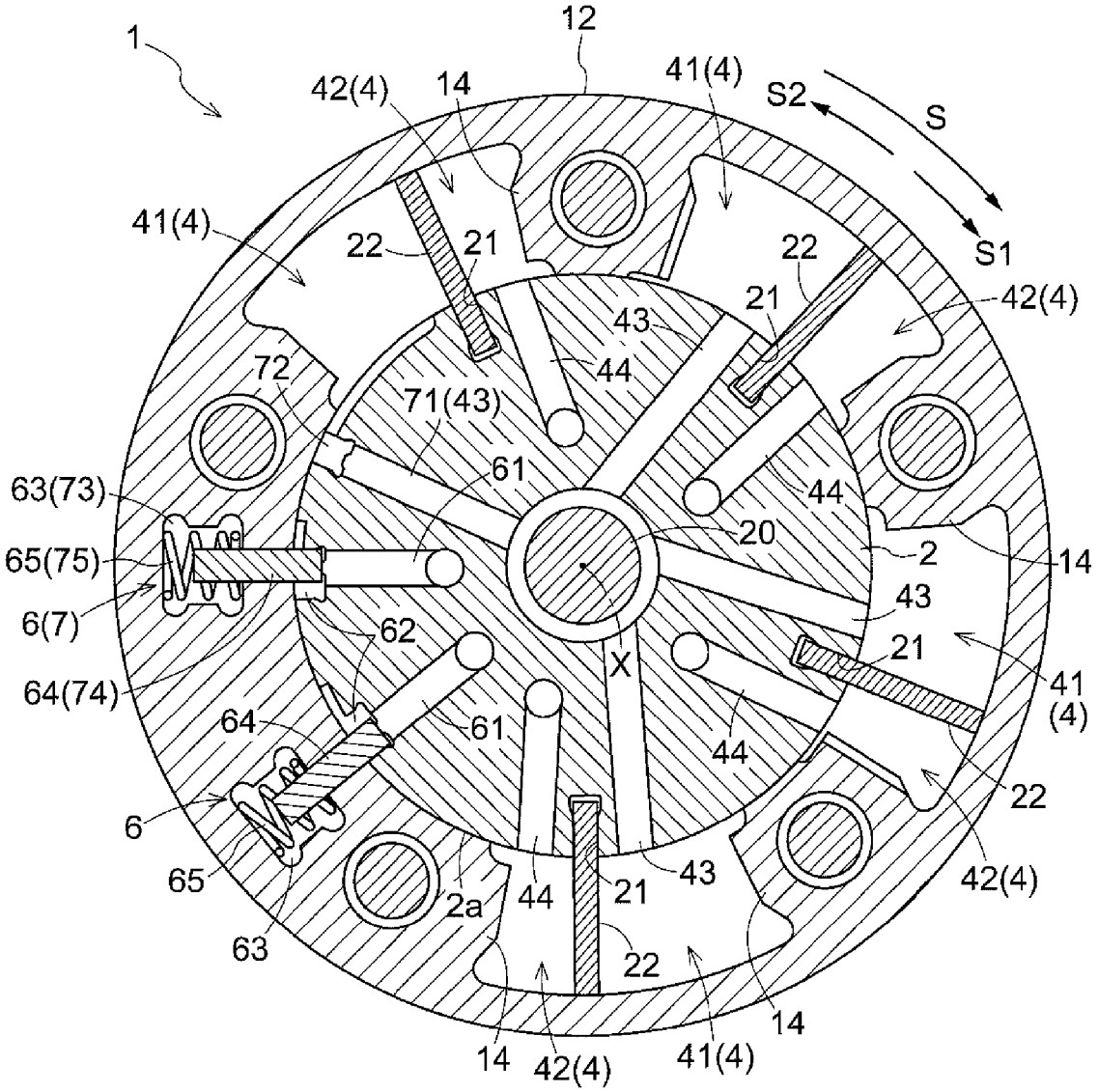
FIG. 2 shows a cross-section of a locked state taken along line II-II in FIG. 1.
Figure 3:
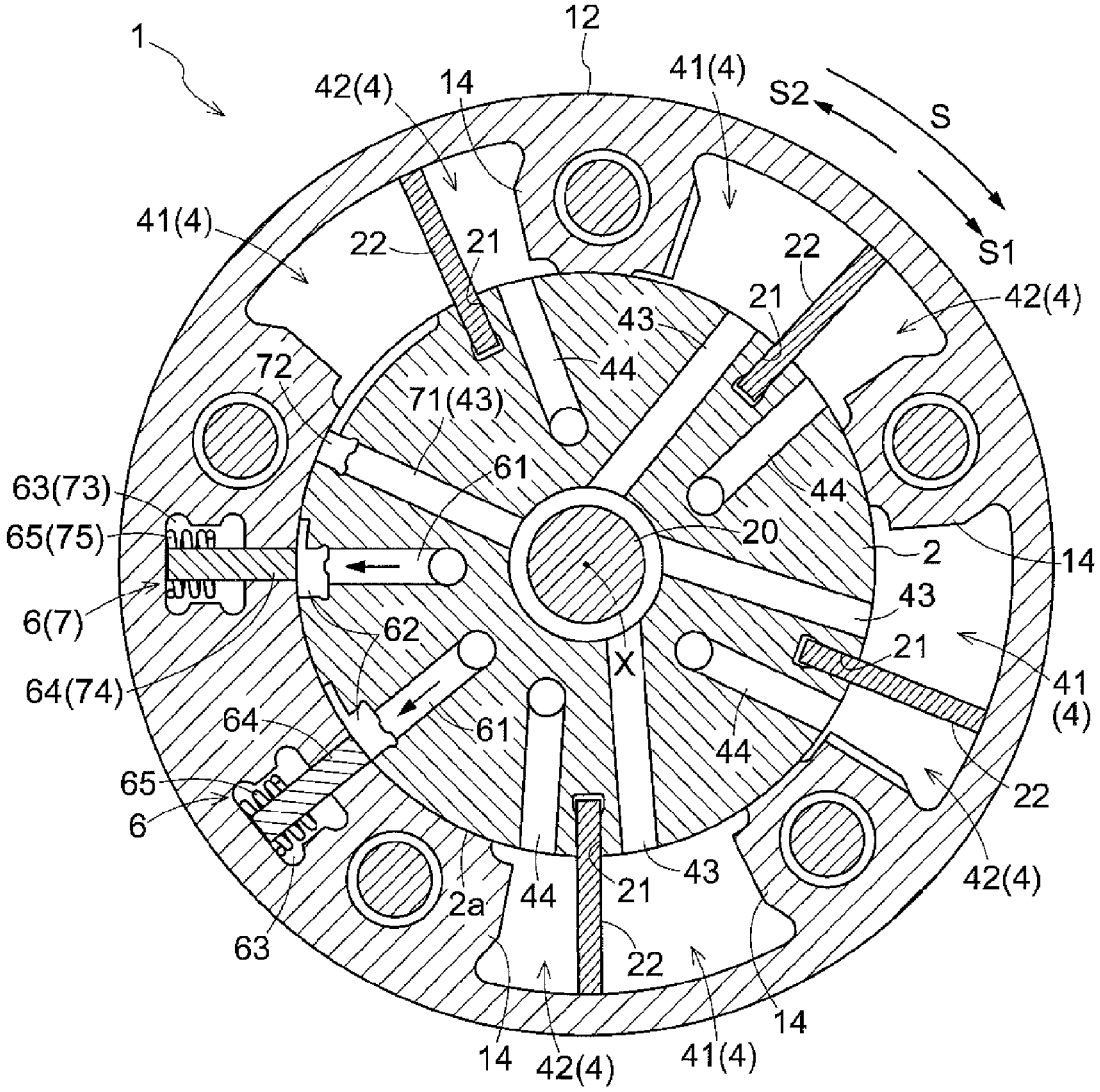
FIG. 3 shows a cross-section of an unlocked state taken along line II-II in FIG. 1.
Figure 4:
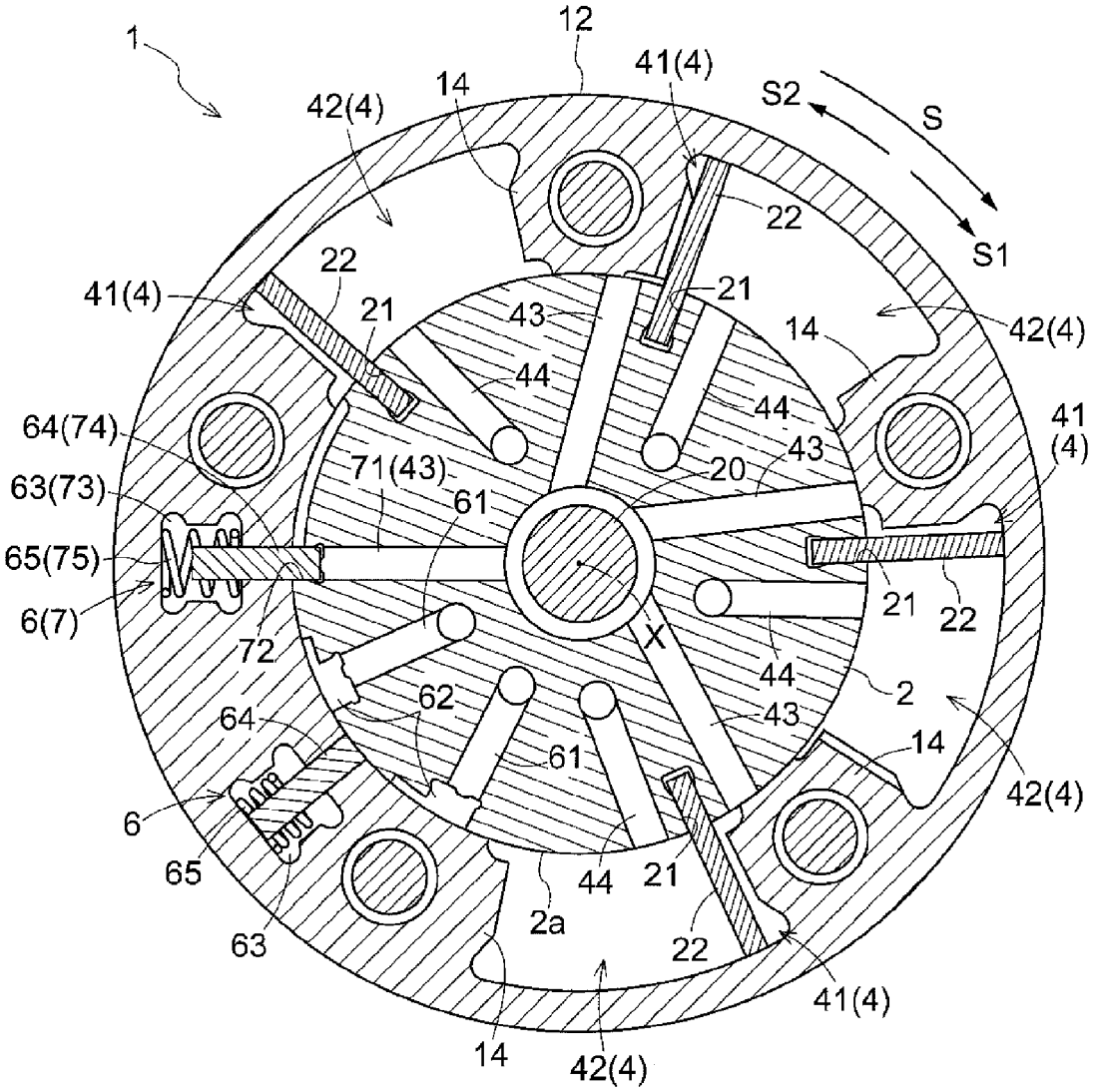
FIG. 4 shows a cross-section of a state of a most retarded phase taken along line II-II in FIG. 1.

The valve opening/closing timing control device according to the present invention is configured to be capable of easily determining whether a lock member is at an intermediate locked phase when setting a relative rotation phase of a driven-side rotary member with respect to a drive-side rotary member to the intermediate lock phase. Following is a detailed description of a valve opening/closing timing control device 1 of the present embodiment. FIG. 1 is a side cross-sectional view that shows the overall configuration of the valve opening/closing timing control device 1 according to the present embodiment. FIGS. 2 to 4 show cross-sections of various states taken along line II-II in FIG. 1. The valve opening/closing timing control device 1 is installed, for example, in a vehicle equipped with an engine serving as an internal combustion engine E as a drive source, or in a hybrid vehicle equipped with a drive source that includes an engine and an electric motor.

The valve opening/closing timing control device 1 is configured with an external rotor 12 serving as a drive-side rotary member, and an internal rotor 2 serving as a driven-side rotary member. The external rotor 12 rotates synchronously with a crankshaft 110 of the internal combustion engine E. The internal rotor 2 rotates in unity with a camshaft 101 of the internal combustion engine E, and is disposed coaxially to the external rotor 12 so as to be capable of rotating relative to the external rotor 12. In the present embodiment, the valve opening/closing timing control device 1 controls opening/closing timing of an intake valve 115 by setting the relative rotation phase (relative rotation angle) of the external rotor 12 and the internal rotor 2 around a center axis X.

The internal rotor 2 is assembled as a single body with an end of the camshaft 101. Specifically, the internal rotor 2 is fixed by fastening to the end of the camshaft 101 with a fastening bolt 20.

The valve opening/closing timing control device 1 is configured with a front plate 11 that has been installed on the opposite side as the side where the camshaft 101 is connected, the external rotor 12, and a rear plate 13 that is installed on the side where the camshaft 101 is connected and has a timing sprocket 15 formed as a single body with the rear plate 13. The external rotor 12 is provided around the exterior of the internal rotor 2, and is held between the front plate 11 and the rear plate 13 from both sides in the axial direction. In this state, the front plate 11, the external rotor 12, and the rear plate 13 are fixed by fastening with the above-mentioned fastening bolt 20.

When the crankshaft 110 rotationally drives, rotational driving force is transmitted to the timing sprocket 15 via a power transmission member 102, and the external rotor 12 rotationally drives in a rotation direction S shown in FIG. 2. With the rotational driving by the external rotor 12, the internal rotor 2 rotationally drives in the rotation direction S and the camshaft 101 rotates, so a cam 116 provided to the camshaft 101 depresses the intake valve 115 of the internal combustion engine E, thereby opening the intake valve 115.

As shown in FIG. 2, in the external rotor 12 a plurality of protruding portions 14 that protrude toward the inside in the diameter direction are formed separated from each other in the rotation direction S, and thus fluid pressure chambers 4 are formed by the external rotor 12 and the internal rotor 2. The protruding portions 14 function as a shoe for an outer circumferential face 2*a* of the internal rotor 2. In the present embodiment, an example is described in which four of the fluid pressure chambers 4 are formed, but this is not a limitation of the invention.

In a portion of the outer circumferential face 2*a* that faces a fluid pressure chamber 4, a vane groove 21 is formed having a depth direction in the diameter direction of the internal rotor 2. A portion of a vane 22 is inserted into the vane groove 21, and the vane 22 is disposed standing outward in the diameter direction. Accordingly, the vane 22 is disposed within the fluid pressure chamber 4.

Also, the fluid pressure chamber 4 is divided by the vane 22 along the rotation direction S into an advance chamber 41 and a retard chamber 42 that permit inflow or discharge of oil. When oil is supplied to the retard chamber 42, the relative rotation phase of the internal rotor 2 with respect to the external rotor 12 is moved (displaced) in a retard direction among relative rotation directions. The retard direction is a direction in which the volume of the retard chamber 42 increases due to oil inflow, and is the direction indicated by reference sign S2 in FIG. 2. When oil is supplied to the advance chamber 41, the relative rotation phase is moved (displaced) in an advance direction among relative rotation directions. The advance direction is a direction in which the vane 22 moves by relative rotation with respect to the external rotor 12 and the volume of the advance chamber 41 increases due to oil inflow, and is the direction indicated by reference sign S1 in FIG. 2. A spring 23 is provided between the vane groove 21 and the vane 22, such that the vane 22 is biased to the outside in the diameter direction. Thus, leakage of oil between the advance chamber 41 and the retard chamber 42 is prevented. The vane 22 selectively allows the relative rotation phase to move in the retard direction or the advance direction.

As shown in FIGS. 1 and 2, advance channels 43 are formed in the internal rotor 2 and the camshaft 101 so as to link with each advance chamber 41. Also, retard channels 44 are formed in the internal rotor 2 and the camshaft 101 so as to link with each retard chamber 42. The advance channels 43 and the retard channels 44 are connected to a predetermined port of a first control valve 174.

By controlling the first control valve 174, supply of the oil to the advance chamber 41 and the retard chamber 42, discharge of the oil from the advance chamber 41 and the retard chamber 42, or supply and discharge of the oil is maintained, to cause the fluid pressure of the oil to act on the vane 22. Thus, the relative rotation phase is displaced in the advance direction S1 or the retard direction S2, or alternatively, is held at an arbitrary phase.

Also, as shown in FIG. 1, a torsion spring 3 is installed across the internal rotor 2 and the front plate 11. The torsion spring 3 biases the internal rotor 2 to the advance side so as to act against an average displacement force in the retard direction S2 based on torque fluctuation of the camshaft 101. Thus, it is possible to smoothly and quickly displace the relative rotation phase in the advance direction S1.

With this sort of configuration, the internal rotor 2 can smoothly move by relative rotation with respect to the external rotor 12 within a defined range around the center axis X. The defined range in which relative rotational movement of the external rotor 12 and the internal rotor 2 is possible, that is, a phase difference between a most advanced phase and a most retarded phase, corresponds to a range in which the vane 22 is displaceable within the fluid pressure chamber 4. The most retarded phase is a phase where the volume of the retard chamber 42 is largest, and the most advanced phase is a phase where the volume of the advance chamber 41 is largest.

In a circumstance in which the fluid pressure of the oil does not stabilize, such as immediately after starting the internal combustion engine E, an intermediate lock mechanism 6 constrains the relative rotation phase of the external rotor 12 and the internal rotor 2 at an intermediate locked phase between the most retarded phase and the most advanced phase by holding the external rotor 12 and the internal rotor 2 at a predetermined relative position. By holding the relative rotation phase at the intermediate locked phase in this way, the rotation phase of the camshaft 101 with respect to the rotation phase of the crankshaft 110 is appropriately maintained, so stable rotation in the internal combustion engine E is realized. Also, in the present embodiment, the intermediate locked phase is a phase in which the valve opening timings of the intake valve 115 and an exhaust valve partially overlap (overlapped timing), or a phase in which the valve closing timing of the exhaust valve is approximately the same as the valve opening timing of the intake valve 115 (zero-lapped timing). As a result, if the intermediate locked phase is a phase in which the valve opening timings of the intake valve 115 and the exhaust valve partially overlap, it is possible to achieve a reduction of hydrocarbons (HC) when starting the internal combustion engine E, thus enabling the internal combustion engine E to have low emissions. Also, if the intermediate locked phase is a phase in which the valve closing timing of the exhaust valve is approximately the same as the valve opening timing of the intake valve 115, the internal combustion engine E can have good starting properties and idling stability at low temperatures.

In the present embodiment, as shown in FIGS. 1 and 2, the intermediate lock mechanism 6 is configured with an intermediate lock channel 61, two intermediate lock grooves 62, a housing 63, two plate-shaped intermediate lock members 64, and a spring 65. Each intermediate lock groove 62 corresponds to a recess of the present invention, and each intermediate lock member 64 corresponds to a lock member of the present invention.

The intermediate lock channel 61 is formed in the internal rotor 2 and the camshaft 101, and connects the intermediate lock grooves 62 with a second control valve 175. By controlling the second control valve 175, it is possible to independently switch supply of oil to or discharge of oil from the intermediate lock grooves 62. The intermediate lock grooves 62 are formed extending in the circumferential direction in the outer circumferential face 2*a* of the internal rotor 2, and have a defined width in the relative rotation direction. A housing 63 is formed in two locations of the external rotor 12. The two intermediate lock members 64 are respectively provided in each housing 63, and are capable of withdrawing in the diameter direction from the housings 63. Therefore, in the present embodiment, the intermediate lock members 64 are formed in the external rotor 12, and are movable with respect to the internal rotor 2. A spring 65 is provided in each housing 63, and biases each intermediate lock member 64 to the inside in the diameter direction, that is, to the side of the intermediate lock grooves 62.

When oil has been discharged from the intermediate lock grooves 62, the two intermediate lock members 64 each protrude and fit into each of the intermediate lock grooves 62, and thus each intermediate lock member 64 simultaneously catches at a predetermined position in the intermediate lock grooves 62. As a result, as shown in FIG. 2, the relative rotation phase of the internal rotor 2 with respect to the external rotor 12 is constrained at the above-stated intermediate locked phase. When the second control valve 175 is controlled to supply oil to the intermediate lock grooves 62, as shown in FIG. 3, both intermediate lock members 64 withdraw from the intermediate lock grooves 62 to the housings 63, so constraint of the relative rotation phase is released, and the internal rotor 2 becomes capable of movement by relative rotation. Hereinafter, a state in which the intermediate lock mechanism 6 is constraining the relative rotation phase at the intermediate phase will be referred to as a "locked state". Also, a state in which the locked state has been released will be referred to as an "unlocked state". The intermediate lock mechanism 6 is configured to be capable of switching between such a "locked state" and an "unlocked state".

Other than the plate-like shape disclosed in the present embodiment, a pin-like shape, for example, can be appropriately adopted as the shape of the intermediate lock members 64.

In the present embodiment, the two intermediate lock grooves 62 are formed with a ratchet structure in which the groove depth becomes deeper in steps in the retard direction S2 in the internal rotor 2. Thus, the intermediate lock members 64 are restricted in steps, so that the intermediate lock members 64 more easily enter into the intermediate lock grooves 62. Also, the intermediate lock channel 61 is branched into two channels in the internal rotor 2, which are connected to the respective intermediate lock grooves 62.

The valve opening/closing timing control device 1 is also provided with a most retarded lock mechanism 7, in addition to the above-described intermediate lock mechanism 6. The most retarded lock mechanism 7, by holding the external rotor 12 and the internal rotor 2 at a predetermined relative position during low speed rotation such as when running the engine at idle, constrains the relative rotation phase to the most retarded phase. That is, because the internal rotor 2 does not move by relative rotation, a state of stable running at idle can be realized, without being affected by displacement force in the retard direction S2 and the advance direction S1 due to torque fluctuation of the camshaft 101. Note that in the present embodiment, the most retarded phase is a phase in which valve opening occurs later than valve closing of the exhaust valve, and is a phase in which starting properties of the internal combustion engine E can be ensured while avoiding pre-ignition of the internal combustion engine E at a warm temperature.

As shown in FIG. 2, the most retarded lock mechanism 7 is provided with a most retarded lock channel 71, a most retarded lock groove 72, a housing 73, a plate-shaped most retarded lock member 74, and a spring 75. In the present embodiment, the most retarded lock channel 71 is configured as the same component as one among the plurality of advance channels 43. The most retarded lock member 74 is the same member as the intermediate lock member 64 on the side in the advance direction S1 among the two intermediate lock members 64. Likewise, the housing 73 is the same as the housing 63 on the side in the advance direction S1 among the two housings 63, and the spring 75 is the same as the spring 65 provided in that housing 63.

In this sort of configuration, when oil has been discharged from the most retarded lock groove 72, the most retarded lock member 74 protrudes into the most retarded lock groove 72. As shown in FIG. 4, when the most retarded lock member 74 is caught in the most retarded lock groove 72, relative rotational movement of the internal rotor 2 with respect to the external rotor 12 is constrained, so the relative rotation phase is held at the most retarded phase. When the first control valve 174 is controlled to displace the relative rotation phase to the advance side, oil is supplied to the most retarded lock groove 72, and the most retarded lock member 74 withdraws from the most retarded lock groove 72 to the housing 73. That is, the constraint of the relative rotation phase is released.

When the relative rotation phase is a phase other than the most retarded phase, the most retarded lock member 74 is offset from the most retarded lock groove 72, and therefore merely slides in contact with the outer circumferential face 2*a* of the internal rotor 2. Other than the plate-like shape disclosed in the present embodiment, a pin-like shape, for example, can be appropriately adopted as the shape of the most retarded lock member 74.

In this sort of configuration, in an intermediate locked state as shown in FIG. 2, if supply of electric power to the second control valve 175 is stopped, the unlocked state as shown in FIG. 3 is established. Thereafter, as long as supply of electric power to the second control valve 175 continues to be stopped, oil continues to be supplied to the intermediate lock grooves 62, so the intermediate lock members 64 do not enter into the intermediate lock grooves 62.

As shown in FIG. 4, when the relative rotation phase is displaced to the most retarded phase and the most retarded lock member 74 opposes the most retarded lock groove 72, the most retarded lock member 74 (64) enters into the most retarded lock groove 72, establishing the most retarded locked state.

Thus, with the configuration of the present embodiment, the configuration can be simplified, and also the number of components can be reduced, so manufacturing cost can be reduced. Also, a common member is used for the intermediate lock member 64 and the most retarded lock member 74, resulting in a surplus of space in the external rotor 12 in the circumferential direction, so as shown in FIG. 2, the fluid pressure chambers 4 can be provided in four locations. As a result, the force that displaces the relative rotation phase increases, so quick phase displacement can be realized. Also, the width of the fluid pressure chambers 4 in the circumferential direction can be increased, thereby increasing the range in which the relative rotation phase can be displaced.

Next is a description of the configuration of a hydraulic circuit according to the present embodiment. As shown in FIG. 1, the hydraulic circuit includes a pump 171 that is driven by the internal combustion engine E to supply oil, the first control valve 174 that controls the supply of oil to the fluid pressure chambers 4, and the second control valve 175 that controls the supply of oil to the intermediate lock mechanism 6.

A phase control unit 180 performs operational control of the first control valve 174 and the second control valve 175 in order to control the above-described relative rotation phase. The phase control unit 180 controls supply of fluid to the retard chamber 42 and discharge of fluid from the advance chamber 41, or discharge of fluid from the retard chamber 42 and supply of fluid to the advance chamber 41, such that the intermediate lock members 64 attain the intermediate locked phase, for example. The phase control unit 180 is configured using a computational processing apparatus, and may be configured with a single control device or with a plurality of control devices.

In the present embodiment, the pump 171 is configured with a mechanical hydraulic pump that is driven by torque transmitted from the crankshaft 110 of the internal combustion engine E. The pump 171 sucks in oil that has accumulated in an oil pan 176 from a suction port, and discharges that oil from a discharge port to a downstream side. The discharge port of the pump 171 is linked to predetermined ports of the first control valve 174 and the second control valve 175.

As the first control valve 174, for example, it is possible to use a variable electromagnetic spool valve that, against a spring, displaces a spool that has been slidably disposed within a sleeve according to application of electric power from the phase control unit 180 to a solenoid. This first control valve 174 includes an advance port that links to the advance channels 43, a retard port that links to the retard channels 44, a supply port that links to a fluid path on the downstream side of the pump 171, and a drain port that links to the oil pan 176.

The first control valve 174 is configured with a three-position control valve capable of performing three states of control: an advance control in which the advance port is linked to a supply port and the retard port is linked to the drain port, a retard control in which the retard port is linked to a supply port and the advance port is linked to the drain port, and a hold control in which the advance port and the retard port are closed. When performing the advance control, the vane 22 moves by relative rotation with respect to the external rotor 12 in the advance direction S1, and the relative rotation phase is displaced to the advance side. When performing the retard control, the vane 22 moves by relative rotation with respect to the external rotor 12 in the retard direction S2, and the relative rotation phase is displaced to the retard side. When performing the hold control, the vane 22 does not move by relative rotation, so the relative rotation phase can be held at an arbitrary phase.

When the advance control is performed, oil is supplied to the advance channels 43 and the most retarded lock channel 71. In the most retarded locked state, the most retarded lock channel 71 is closed by the most retarded lock member 74. When the advance control is performed so the most retarded lock member 74 withdraws from the most retarded lock groove 72 and thus a most retarded unlocked state is established, oil is supplied to the advance chambers 41 via the advance channels 43 and the internal rotor 2 moves by relative rotation to the advance side.

Also, the first control valve 174 is controlled to operate by the phase control unit 180, and controls supply or discharge of oil to/from the advance chambers 41 and the most retarded lock channel 71, or the retard chambers 42. Thus, the first control valve 174 controls switching of the locked state or the released state of the intermediate lock mechanism 6, and controls the relative rotation phase of the internal rotor 2 with respect to the external rotor 12. In the present embodiment, a state in which retard control is possible is established when electric power is supplied to the first control valve 174, and a state in which advance control is possible is established when supply of electric power to the first control valve 174 is stopped. Also, the first control valve 174 sets an opening degree by adjustment of a duty ratio of the electric power supplied to the electromagnetic solenoid. Thus, fine adjustments of the amount of oil supplied or discharged are possible.

The second control valve 175 is configured with a variable electromagnetic spool valve, like the first control valve 174. The second control valve 175 includes a restricting port that links to the intermediate lock channels 61, a supply port that links to a fluid path on the downstream side of the pump 171, and a drain port that links to the oil pan 176. The second control valve 175 is configured as a two-position control valve capable of performing two states of control: a release control in which the restricting port is linked to the supply port, and a restriction control in which the restricting port is linked to the drain port. The second control valve 175 is controlled to operate by the phase control unit 180, and controls supply or discharge of oil to/from the intermediate lock grooves 62 of the intermediate lock mechanism 6. Thus, the second control valve 175 controls switching of a restricted state or a released state of the intermediate lock mechanism 6.

Supply of oil to the intermediate lock grooves 62 and discharge of oil from the intermediate lock grooves 62 are switchable by the second control valve 175. Note that in the present embodiment, the second control valve 175 is configured such that a state in which oil can be discharged from the intermediate lock grooves 62 is established when electric power is supplied, and a state in which oil is supplied to the intermediate lock grooves 62 is established when supply of electric power is stopped.

Here, a crank angle sensor that detects a rotation angle of the crankshaft 110 of the internal combustion engine E is provided in the vicinity of the crankshaft 110. Also, a camshaft angle sensor that detects a rotation angle of the camshaft 101 is provided in the vicinity of the camshaft 101. The phase control unit 180 detects the relative rotation phase from the results of detection by the crank angle sensor and the camshaft angle sensor, and determines what phase to which the relative rotation phase has been set. Also, ignition key ON/OFF information or the like is transmitted to the phase control unit 180. Also, control information regarding optimal relative rotation phases depending on running states of the internal combustion engine E are stored within a memory of the phase control unit 180. The phase control unit 180 controls the relative rotation phase according to the running state of the internal combustion engine E.

After the phase control unit 180 executes the control to supply fluid to the retard chamber 42 and discharge fluid from the advance chamber 41, or executes the control to discharge fluid from the retard chamber 42 and supply fluid to the advance chamber 41, when control has been performed such that the intermediate lock members 64 move toward a determination phase that has been set at a different position than the intermediate locked phase in the intermediate lock grooves 62, a determination unit 181 determines whether the intermediate lock members 64 will attain the determination phase, and when the result of that determination is that the intermediate lock members 64 will not attain the determination phase, the determination unit 181 determines that the relative rotation phase is in the locked state. The control to supply fluid to the retard chamber 42 and discharge fluid from the advance chamber 41, or control to discharge fluid from the retard chamber 42 and supply fluid to the advance chamber 41, is control to supply or discharge a working oil of the advance chamber 41 and the retard chamber 42 such that the intermediate lock members 64 are set to the intermediate locked phase.

Figure 5:
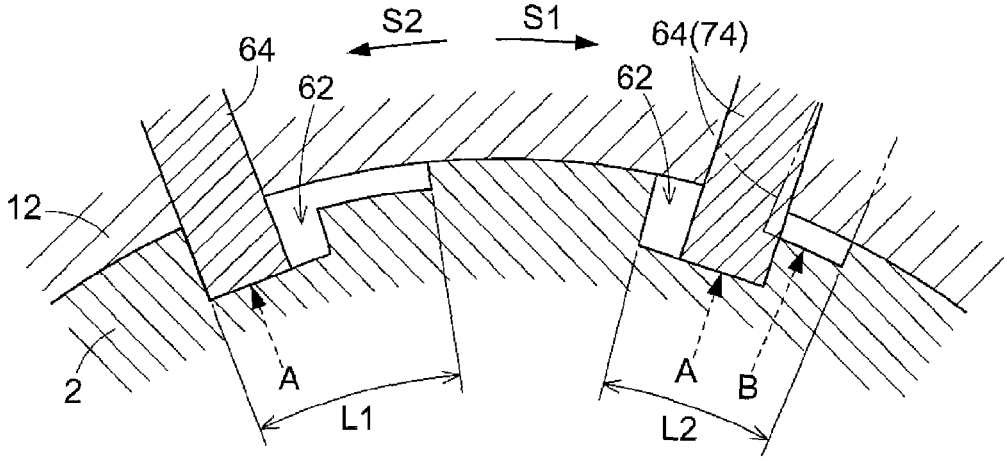
FIG. 5 schematically shows an intermediate locked phase and a determination phase.

The intermediate locked phase and the determination phase according to the present embodiment are schematically shown in FIG. 5. In FIG. 5, a locked state is shown in which the intermediate lock members 64 have been fitted into the respective intermediate lock grooves 62. A position A where the intermediate lock members 64 exist in such a state corresponds to the position of the intermediate locked phase. The position of the determination phase is set to a different position than this position A. The position of the determination phase is indicated by reference sign B.

In the present embodiment, the position of the determination phase is provided at either one of the two intermediate lock grooves 62. Specifically, when one of the intermediate lock members 64 is in a state in which a phase change is restricted within the corresponding intermediate lock groove 62, the determination phase is set to the intermediate lock groove 62 that corresponds to a portion where the range of restriction for the intermediate locked phase is narrow. Here, when the relative rotation phase is set to the intermediate locked phase, the intermediate lock members 64 that fit into the respective intermediate lock grooves 62 have been set in advance. Accordingly, the corresponding intermediate lock groove 62 means the intermediate lock groove 62 into which a predetermined intermediate lock member 64 is fitted when the relative rotation phase is set to the intermediate locked phase. "When one of the intermediate lock members 64 is in a state in which a phase change is restricted within the corresponding intermediate lock groove 62" means a state in which the intermediate lock member 64 is in some position within the intermediate lock groove 62. The range of restriction for the intermediate locked phase means a range in which the intermediate lock member 64 can move in a state in which the intermediate lock member 64 has been fitted into the intermediate lock groove 62. In FIG. 5, for the intermediate lock groove 62 on the side of the retard direction S2, the range indicated by reference sign L1 corresponds to the range of restriction, and for the intermediate lock groove 62 on the side of the advance direction S1, the range indicated by reference sign L2 corresponds to the range of restriction. Accordingly, in the present embodiment, the intermediate lock groove 62 on the side of the advance direction S1 corresponds to the intermediate lock groove 62 on the side where the range of restriction is narrow.

In the present embodiment, within the side having shallower depth in the intermediate lock groove 62 on the side of the advance direction S1, the determination phase is set to the side of an end separated from position A of the intermediate locked phase. More specifically, in a case where the intermediate lock member 64 is positioned at this end, the determination phase is set to a position in the center in the circumferential direction of the intermediate lock member 64. In FIG. 5, for ease of understanding, the intermediate lock member 64 positioned at this end is indicated by a double-dotted chained line.

From a state in which the two intermediate lock members 64 are not respectively positioned within the intermediate lock grooves 62, when the internal rotor 2 rotates in the advance direction S1 and shifts to the intermediate locked phase, when the control to supply/discharge the working oil of the advance chamber 41 and the retard chamber 42 such that the intermediate lock members 64 are set to the intermediate locked phase, performed by the phase control unit 180, ends, the determination unit 181 again causes the phase control unit 180 to perform control to supply/discharge the working oil such that the intermediate lock members 64 rotate in the direction of the advance direction S1 (referred to below as "determination control"). This determination control corresponds to the above "control performed such that the intermediate lock members 64 move toward a determination phase that has been set at a different position than the intermediate locked phase in the intermediate lock grooves 62". After this determination control, when the determination unit 181 has determined that the intermediate lock members 64 have attained position B of the determination phase, that determination result is transmitted to the phase control unit 180. In this case, the phase control unit 180 recognizes that the relative rotation phase of the internal rotor 2 with respect to the external rotor 12 is not at the intermediate locked phase (recognizes that the intermediate lock members 64 have passed the intermediate locked phase), and the phase control unit 180 controls the first control valve 174 to rotate the internal rotor 2 in the retard direction S2 to shift the relative rotation phase to the intermediate locked phase.

On the other hand, after the determination control, when the determination unit 181 has determined that the intermediate lock members 64 have not attained position B of the determination phase, that determination result is transmitted to the phase control unit 180. In this case, the phase control unit 180 recognizes that the relative rotation phase of the internal rotor 2 with respect to the external rotor 12 is at the intermediate locked phase, and the phase control unit 180 stops control of the first control valve 174.

Also, in a case where the internal rotor 2 rotates in the retard direction S2 and shifts to the intermediate locked phase from a state in which the two intermediate lock members 64 are not respectively positioned within the intermediate lock grooves 62, when the control to supply/discharge the working oil of the advance chamber 41 and the retard chamber 42 such that the intermediate lock members 64 are set to the intermediate locked phase, performed by the phase control unit 180, ends, the determination unit 181 again causes the phase control unit 180 to perform control to supply/discharge the working oil such that the intermediate lock members 64 rotate in the direction of the advance direction S1 (again causes determination control to be performed). After this determination control, when the determination unit 181 has determined that the intermediate lock members 64 have attained position B of the determination phase, that determination result is transmitted to the phase control unit 180. In this case, the phase control unit 180 recognizes that the relative rotation phase of the internal rotor 2 with respect to the external rotor 12 is not at the intermediate locked phase, and the phase control unit 180 controls the first control valve 174 to rotate the internal rotor 2 in the retard direction S2 to shift the internal rotor 2 to the intermediate locked phase.

On the other hand, after the determination control, when the determination unit 181 has determined that the intermediate lock members 64 have not attained position B of the determination phase, that determination result is transmitted to the phase control unit 180. In this case, the phase control unit 180 recognizes that the relative rotation phase of the internal rotor 2 with respect to the external rotor 12 is at the intermediate locked phase, and the phase control unit 180 stops control of the first control valve 174.

In other words, the form of the above sequence can be restated as follows. Viewed from the current position of the intermediate lock members 64, in a state in which the current position of the intermediate lock members 64, the intermediate locked phase, and the determination phase are lined up in that order, in a case where control has been performed such that the intermediate lock members 64 attain the intermediate locked phase, it is possible to determine that the intermediate lock members 64 are in the intermediate locked phase (determine that the relative rotation phase of the internal rotor 2 with respect to the external rotor 12 is in the intermediate locked phase) if the intermediate lock members 64 do not attain the determination phase in the last determination operation. Also, viewed from the current position of the intermediate lock members 64, in a state in which the current position of the intermediate lock members 64, the determination phase, and the intermediate locked phase are lined up in that order, in a case where control has been performed such that the intermediate lock members 64 attain the intermediate locked phase, it is possible to determine that the intermediate lock members 64 are in the intermediate locked phase if the intermediate lock members 64 pass through the determination phase and do not attain the determination phase again in the last determination operation.

In the present embodiment, in a case where the determination unit 181 has determined that the intermediate lock members 64 have not attained the determination phase after the phase control unit 180 executes control to supply fluid to the retard chamber 42 and discharge fluid from the advance chamber 41, or control to discharge fluid from the retard chamber 42 and supply fluid to the advance chamber 41, the phase control unit 180 supplies fluid alternately to each of the retard chamber 42 and the advance chamber 41. A case where the determination unit 181 has determined that the intermediate lock members 64 have not attained the determination phase after the phase control unit 180 executes control to supply fluid to the retard chamber 42 and discharge fluid from the advance chamber 41, or control to discharge fluid from the retard chamber 42 and supply fluid to the advance chamber 41, corresponds to a case where the intermediate lock members 64 are positioned at the intermediate locked phase. In this case, the relative rotation of the internal rotor 2 and the external rotor 12 is restricted, so by the phase control unit 180 supplying fluid alternately to each of the retard chamber 42 and the advance chamber 41, in a state in which the relative rotation has been restricted, the vanes 22 are swung in the advance direction S1 and the retard direction S2. In this way, it is possible to determine that the intermediate lock members 64 have reliably been fitted into the intermediate lock grooves 62 if the intermediate lock members 64 do not attain the determination phase. Accordingly, with this configuration, it is possible to confirm a state in which the intermediate lock members 64 have been fitted into the intermediate lock grooves 62. Also, by increasing/decreasing the oil pressure of the retard chamber 42 and the advance chamber 41, along with the oil pressure of the retard chamber 42 and the advance chamber 41, the oil pressure of channels connected to the retard chamber 42 and the advance chamber 41 also increases/decreases, so it is possible for a foreign substance within the channels to be flushed through and removed (thus cleaning the channels).

Thus, according to this valve opening/closing timing control device 1, the determination phase is provided at a different position than the intermediate locked phase in the intermediate lock grooves 62, so when shifting the relative rotation phase to the intermediate locked phase, by merely performing control using a target position where the intermediate locked phase is attained (target phase), it is possible to determine whether the intermediate lock members 64 have attained the intermediate locked phase. Also, in the determination operation, it is sufficient to perform control such that the intermediate lock members 64 move to the side of the determination phase, so it is possible to shorten the time required to switch the first control valve 174, for example. Accordingly, it is possible to quickly determine that the intermediate locked phase has been attained.

OTHER EMBODIMENTS

Figure 6:
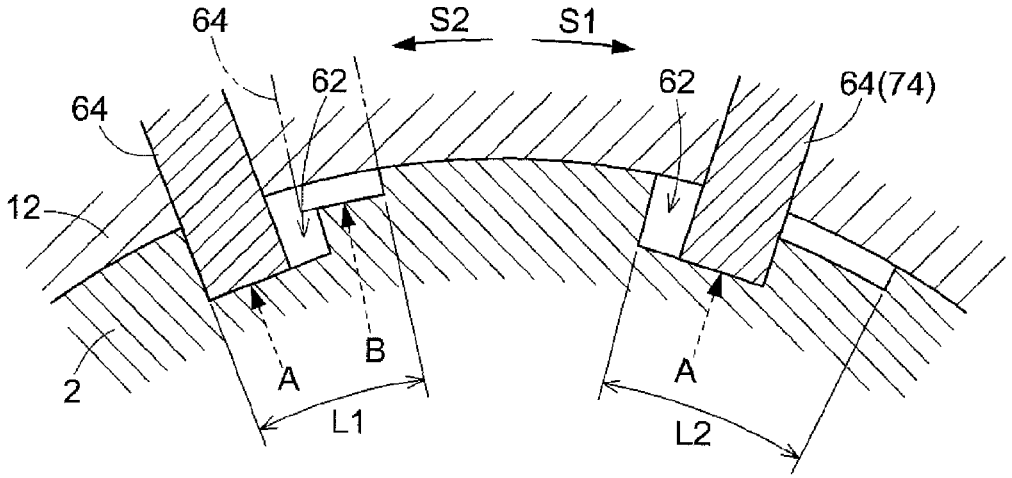
FIG. 6 schematically shows an intermediate locked phase and a determination phase according to another embodiment.

In the above embodiment, an example was described in which the determination phase is set to position B of the intermediate lock groove 62 on the side of the advance direction S1 in FIG. 5. However, this is not a limitation on the range of application of the present invention. For example, as shown in FIG. 6, in a case where a distance in the circumferential direction of the intermediate lock groove 62 on the side of the retard direction S2 is shorter than a distance in the circumferential direction of the intermediate lock groove 62 on the side of the advance direction S1 (L1<L2), it is of course possible to set the determination phase to a predetermined position B on the side of the advance direction S1 within the intermediate lock groove 62 on the side of the retard direction S2.

Figure 7:
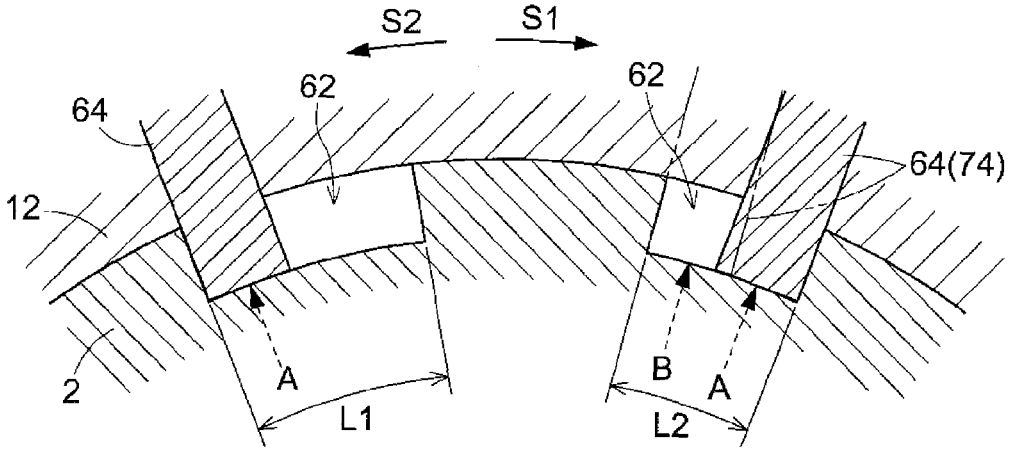
FIG. 7 schematically shows an intermediate locked phase and a determination phase according to another embodiment.

In the above embodiment, an example was described in which the two intermediate lock grooves 62 are formed with a ratchet structure in which the groove depth becomes deeper in steps in the retard direction S2 in the internal rotor 2. However, this is not a limitation on the range of application of the present invention. For example, as shown in FIG. 7, a configuration may of course also be adopted in which the intermediate lock grooves 62 have a uniform groove depth. In this case, position A of the intermediate locked phase is provided at a predetermined position on the side of the advance direction S1 in the intermediate lock groove 62 on the side of the advance direction S1, and is provided at a predetermined position on the side of the retard direction S2 in the intermediate lock groove 62 on the side of the retard direction S2. Also, in a case where two of the intermediate lock grooves 62 are provided, and the length in the circumferential direction of one of the intermediate lock grooves 62 is shorter than the length of the other intermediate lock groove 62, it is desirable to provide the determination phase within the intermediate lock groove 62 that has the shorter length in the circumferential direction. Specifically, for example as shown in FIG. 7, in a case where the distance in the circumferential direction of the intermediate lock groove 62 on the side of the advance direction S1 is shorter than the distance in the circumferential direction of the intermediate lock groove 62 on the side of the retard direction S2 (L1>L2), it is suitable to set the determination phase to a predetermined position B on the side of the retard direction S2 within the intermediate lock groove 62 on the side of the advance direction S1.

Figure 8:
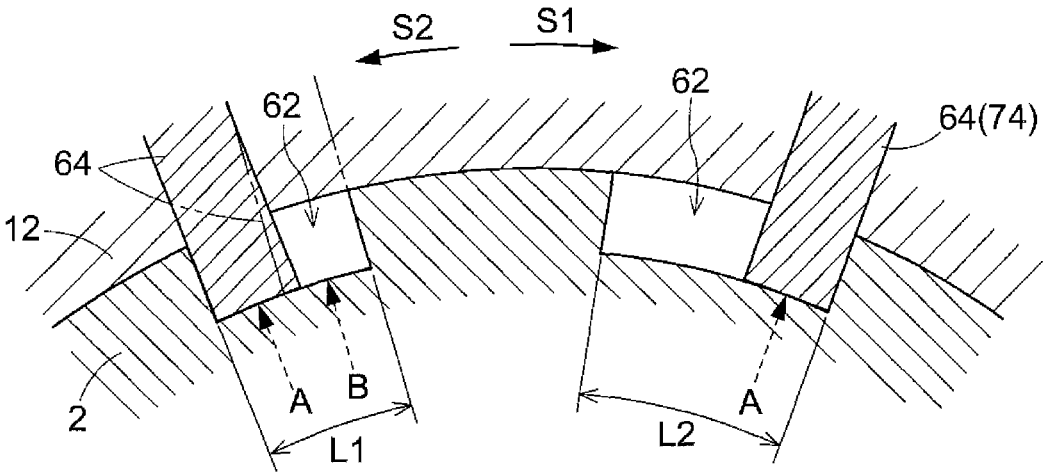
FIG. 8 schematically shows an intermediate locked phase and a determination phase according to another embodiment.

Also, for example as shown in FIG. 8, in a case where the distance in the circumferential direction of the intermediate lock groove 62 on the side of the retard direction S2 is shorter than the distance in the circumferential direction of the intermediate lock groove 62 on the side of the advance direction S1 (L1<L2), it is suitable to set the determination phase to a predetermined position B on the side of the advance direction S1 within the intermediate lock groove 62 on the side of the retard direction S2.

Figure 9:
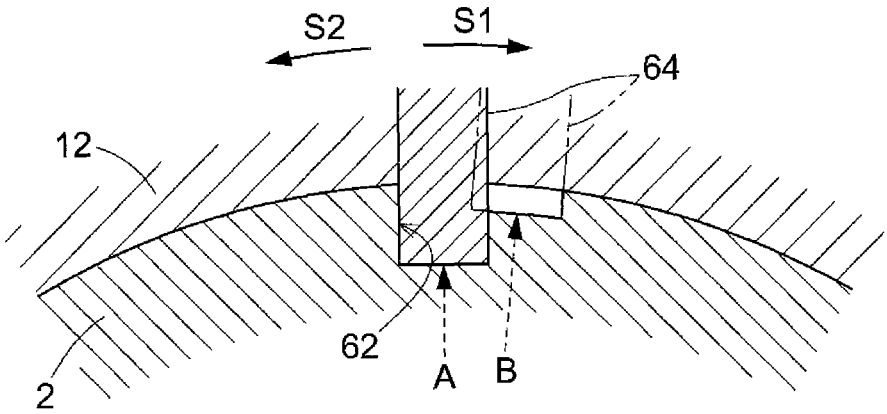
FIG. 9 schematically shows an intermediate locked phase and a determination phase according to another embodiment.

Also, in the above embodiment, an example was described in which two each of the intermediate lock grooves 62 and the intermediate lock members 64 are provided. However, this is not a limitation on the range of application of the present invention. For example, as shown in FIG. 9, a configuration may also be adopted in which one each of the intermediate lock groove 62 and the intermediate lock member 64 are provided, and the intermediate lock groove 62 is formed with a ratchet structure in which the groove depth becomes deeper in steps in the retard direction S2 in the internal rotor 2. In this case, it is suitable to set the length in the circumferential direction on a side where the groove depth is deeper than other portions such that when the intermediate lock member 64 has been fitted into the groove on that deep side, the external rotor 12 and the internal rotor 2 do not rotate relative to each other. More specifically, it is suitable to set that length such that displacement of the relative rotation phase of the internal rotor 2 with respect to the external rotor 12 is prohibited.

Figure 10:
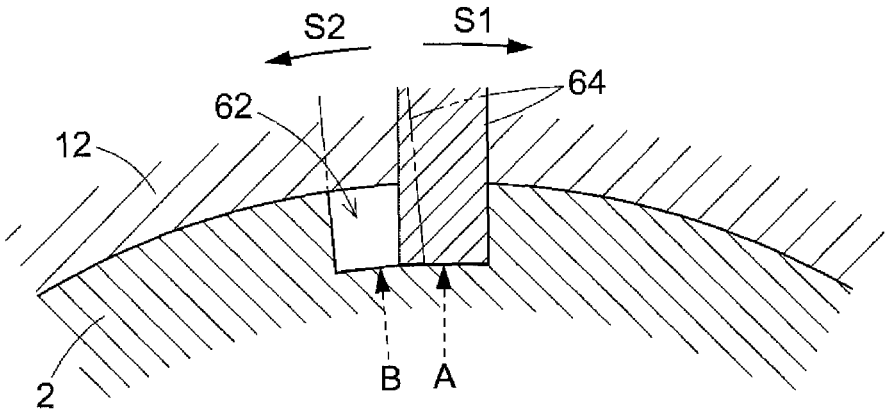
FIG. 10 schematically shows an intermediate locked phase and a determination phase according to another embodiment.

Furthermore, for example as shown in FIG. 10, a configuration is also possible in which the groove depth of the intermediate lock groove 62 is uniform. In this case, it is suitable to set the length in the circumferential direction of the intermediate lock groove 62 such that even when the intermediate lock member 64 has been fitted into the intermediate lock groove 62, relative rotation of the external rotor 12 and the internal rotor 2 can be permitted. That is, it is suitable to set that length such that displacement of the relative rotation phase of the internal rotor 2 with respect to the external rotor 12 is possible.

In the examples shown in FIGS. 7 to 10 as well, viewed from the current position of the intermediate lock members 64, in a state in which the current position of the intermediate lock members 64, the intermediate locked phase, and the determination phase are lined up in that order, in a case where control has been performed such that the intermediate lock members 64 attain the intermediate locked phase, it is possible to determine that the intermediate lock members 64 are in the intermediate locked phase if the intermediate lock members 64 do not attain the determination phase again in the last determination operation. Also, viewed from the current position of the intermediate lock members 64, in a state in which the current position of the intermediate lock members 64, the determination phase, and the intermediate locked phase are lined up in that order, in a case where control has been performed such that the intermediate lock members 64 attain the intermediate locked phase, it is possible to determine that the intermediate lock members 64 are in the intermediate locked phase if the intermediate lock members 64 pass through the determination phase and do not attain the determination phase again in the last determination operation. Note that in the examples shown in FIGS. 9 and 10, a configuration may be adopted in which the intermediate lock member 64 is the same component as the most retarded lock member 74, or a configuration may be adopted in which the intermediate lock member 64 and the most retarded lock member 74 are provided as separate components.

In the above embodiment, an example was described in which the intermediate lock members 64 are provided in the external rotor 12, and the intermediate lock grooves 62 are provided in the internal rotor 2. However, this is not a limitation on the range of application of the present invention. A configuration may of course also be adopted in which the intermediate lock members 64 are provided in the internal rotor 2, and the intermediate lock grooves 62 are provided in the external rotor 12.

In the above embodiment, an example was described in which the determination phase is provided at any one of the two intermediate lock grooves 62. However, this is not a limitation on the range of application of the present invention. A configuration is also possible in which the determination phase is provided at both of the two intermediate lock grooves 62.

In the above embodiment, an example is described in which the determination phase is set to the intermediate lock groove 62 on the side having a narrow range of restriction for the intermediate locked phase when the intermediate lock member 64 is in a state in which a phase change is restricted within the intermediate lock groove 62. However, this is not a limitation on the range of application of the present invention. The determination phase can also be set to the intermediate lock groove 62 on the side having a wide range of restriction for the intermediate locked phase when the intermediate lock member 64 is in a state in which a phase change is restricted within the intermediate lock groove 62.

In the above embodiment, an example was described in which, in a case where the determination unit 181 has determined that the intermediate lock members 64 have not attained the determination phase after the phase control unit 180 executes control to supply fluid to the retard chamber 42 and discharge fluid from the advance chamber 41, or control to discharge fluid from the retard chamber 42 and supply fluid to the advance chamber 41, the phase control unit 180 supplies fluid alternately to each of the retard chamber 42 and the advance chamber 41. However, this is not a limitation on the range of application of the present invention. A configuration is of course also possible in which, in a case where the determination unit 181 has determined that the intermediate lock members 64 have not attained the determination phase after the first control valve 174 executes control to supply fluid to the retard chamber 42 and discharge fluid from the advance chamber 41, or control to discharge fluid from the retard chamber 42 and supply fluid to the advance chamber 41, the phase control unit 180 does not supply fluid alternately to each of the retard chamber 42 and the advance chamber 41. Also, a configuration is of course possible in which, when the determination unit 181 determines whether the intermediate lock members 64 will attain the determination phase, the phase control unit 180 supplies fluid alternately to each of the retard chamber 42 and the advance chamber 41.

In the above embodiment, an example was described in which the two intermediate lock grooves 62 are formed with a ratchet structure in which the groove depth becomes deeper in steps in the retard direction S2 in the internal rotor 2. However, this is not a limitation on the range of application of the present invention. A configuration is of course also possible in which only one intermediate lock groove 62 among the two intermediate lock grooves 62 is formed with a ratchet structure in which the groove depth becomes deeper in steps. In this case, the determination phase can be provided at the intermediate lock groove 62 in which the groove depth becomes deeper in steps, and of course can be provided at the intermediate lock groove 62 in which the groove depth does not become deeper in steps.

In the above embodiment, an example was described in which the valve opening/closing timing control device 1 controls the opening/closing timing of the intake valve 115. However, this is not a limitation on the range of application of the present invention. A configuration is of course also possible in which the valve opening/closing timing control device 1 controls the opening/closing timing of an exhaust valve.

INDUSTRIAL APPLICABILITY

The present invention is applicable to valve opening/closing timing control devices that control a relative rotation phase of a driven-side rotary member that rotates in unity with a camshaft of an internal combustion engine with respect to a drive-side rotary member that rotates synchronously with a crankshaft of the internal combustion engine.

REFERENCE SIGNS LIST

1: valve opening/closing timing control device
2: internal rotor (driven-side rotary member)
4: fluid pressure chamber
6: intermediate lock mechanism
12: external rotor (drive-side rotary member)
22: vane
41: advance chamber
42: retard chamber
62: intermediate lock groove (recess)
64: intermediate lock member (lock member)
101: camshaft
110: crankshaft
180: phase control unit
181: determination unit
E: internal combustion engine
S1: advance direction
S2: retard direction

The invention claimed is:

1. A valve opening/closing timing control device, comprising:

a drive-side rotary member that rotates synchronously with a crankshaft of an internal combustion engine;

a driven-side rotary member that rotates in unity with a camshaft of the internal combustion engine, and is capable of relative rotation with respect to the drive-side rotary member;

a fluid pressure chamber that is formed by the drive-side rotary member and the driven-side rotary member;

a vane that is disposed within the fluid pressure chamber, and divides the fluid pressure chamber into a retard chamber and an advance chamber that permit inflow or discharge of a fluid, and selectively moves a relative rotation phase of the driven-side rotary member with respect to the drive-side rotary member between a retard direction in which volume within the retard chamber increases due to inflow of the fluid and an advance direction in which volume within the advance chamber increases due to inflow of the fluid;

an intermediate lock mechanism that includes a lock member provided in any one of the drive-side rotary member and the driven-side rotary member and is capable of moving with respect to an other of the drive-side rotary member and the driven-side rotary member, and a recess that extends in a circumferential direction and is provided in the other of the drive-side rotary member and the driven-side rotary member, the intermediate lock mechanism being capable of switching between a locked state in which the relative rotation phase is constrained to an intermediate locked phase between the most advanced phase and the most retarded phase by the lock member fitting into the recess, and an unlocked state in which the constraint has been released by the lock member withdrawing from the recess;

a phase control unit that controls supply of the fluid to the retard chamber and discharge of the fluid from the advance chamber, or controls discharge of the fluid from the retard chamber and supply of the fluid to the advance chamber, such that the lock member attains the intermediate locked phase; and a determination unit that, after the phase control unit executes the control to supply the fluid to the retard chamber and discharge the fluid from the advance chamber, or executes the control to discharge the fluid from the retard chamber and supply the fluid to the advance chamber, when control has been performed such that the lock member moves toward a determination phase that has been set at a different position than the intermediate locked phase in the recess, determines whether the lock member will attain the determination phase, and when the result of that determination is that the lock member will not attain the determination phase, the determination unit determines that the relative rotation phase is in the locked state.

2. The valve opening/closing timing control device according to claim 1, wherein after the phase control unit executes the control to supply the fluid to the retard chamber and discharge the fluid from the advance chamber or executes the control to discharge the fluid from the retard chamber and supply the fluid to the advance chamber, in a case where the determination unit determined that the lock member has not attained the determination phase, or when the determination unit determines whether the lock member will attain the determination phase, the phase control unit supplies the fluid alternately to each of the retard chamber and the advance chamber.

3. The valve opening/closing timing control device according to claim 1, wherein two each of the recess and the lock member are provided, and the determination phase is provided at any one of the two recesses, and when one of the lock members is in a state in which a phase change is restricted within a corresponding recess, the determination phase has been set to the recess that corresponds to a portion where a range of restriction for the intermediate locked phase is narrow.

4. The valve opening/closing timing control device according to claim 1, wherein two recesses are provided, the length in the circumferential direction of one recess is shorter than the length of the other recess, and the determination phase is provided within the recess that has a shorter length in the circumferential direction.

5. The valve opening/closing timing control device according to claim 1, wherein one each of the recess and the lock member are provided, the depth of the recess increases in steps in the retard direction, and the length in the circumferential direction of a portion of the recess that is deeper than other portions is set such that when the lock member has fitted into the deep portion of the recess, displacement of the relative rotation phase of the driven-side rotary member with respect to the drive-side rotary member is prohibited.

6. The valve opening/closing timing control device according to claim 1, wherein one each of the recess and the lock member are provided, and the length in the circumferential direction of the recess is set such that in a case where the lock member has fitted into the recess, the relative rotation phase of the driven-side rotary member with respect to the drive-side rotary member is displaceable.

* * * * *